US010745913B2

(12) United States Patent
Dicaire et al.

(10) Patent No.: US 10,745,913 B2
(45) Date of Patent: Aug. 18, 2020

(54) BUILDING SHRINKAGE COMPENSATION DEVICE WITH ROTATING GEARS

(71) Applicant: OMG, Inc., Agawam, MA (US)

(72) Inventors: Mark A. Dicaire, Northborough, MA (US); Jonathan W. Dezielle, Agawam, MA (US)

(73) Assignee: OMG, Inc., Agawam, MA (US)

( * ) Notice: Subject to any disclaimer, the term of this patent is extended or adjusted under 35 U.S.C. 154(b) by 0 days.

(21) Appl. No.: 16/214,475

(22) Filed: Dec. 10, 2018

(65) Prior Publication Data

US 2019/0106879 A1 Apr. 11, 2019

Related U.S. Application Data

(63) Continuation-in-part of application No. 15/922,041, filed on Mar. 15, 2018, now Pat. No. 10,151,107, which is a continuation of application No. 15/468,610, filed on Mar. 24, 2017, now Pat. No. 9,938,714.

(60) Provisional application No. 62/312,514, filed on Mar. 24, 2016.

(51) Int. Cl.

| | |
|---|---|
| ***E04B 2/70*** | (2006.01) |
| ***E04H 9/14*** | (2006.01) |
| ***E04B 1/26*** | (2006.01) |
| ***E04B 1/41*** | (2006.01) |

(52) U.S. Cl.

CPC ..... *E04B 2/706* (2013.01); *E04B 1/2604* (2013.01); *E04B 1/40* (2013.01); *E04H 9/14* (2013.01); *E04B 2001/2688* (2013.01); *E04B 2103/04* (2013.01)

(58) Field of Classification Search

CPC ..... E04B 2/706; E04B 1/2604; E04B 1/40; E04B 2001/2688; E04B 2103/04; E04H 9/14

USPC ..... 52/236.3

See application file for complete search history.

(56) References Cited

U.S. PATENT DOCUMENTS

| | | | | |
|---|---|---|---|---|
| 2,299,323 A | | 10/1942 | Hetky | |
| 2,580,829 A | * | 1/1952 | Peck | B66F 3/12 254/122 |
| 2,587,792 A | | 3/1952 | Von Sivers | |
| 2,625,368 A | | 1/1953 | Warner | |
| 2,653,553 A | | 9/1953 | Jacobs | |
| 2,696,240 A | | 12/1954 | Crowder | |
| 2,703,233 A | | 3/1955 | Johnson | |

(Continued)

FOREIGN PATENT DOCUMENTS

| | | |
|---|---|---|
| CN | 205325456 U | 6/2016 |
| CN | 205954716 U | 2/2017 |

(Continued)

*Primary Examiner* — Jeanette E Chapman

(74) *Attorney, Agent, or Firm* — Alix, Yale & Ristas, LLP

(57) ABSTRACT

A device for compensating for the natural shrinkage of building materials includes one or more gear members mounted on a base plate. A fastener extends through a hole in the base plate and axially fixed relative to the gear member. The gear member is engaged with teeth in the base plate and rotatable relative to the fastener. The axis of rotation of the gear member is not aligned with its central axis. The base plate can be securely fastened to a first building member with the fastener axially fixed relative to a second building member but not axially fixed relative to the base plate and first building member.

20 Claims, 16 Drawing Sheets

(56) References Cited

U.S. PATENT DOCUMENTS 2,708,462 A 5/1955 Frear
2,741,514 A 4/1956 Fisher
2,863,489 A * 12/1958 Priest ..... B21D 1/12 72/390.7
2,950,085 A 8/1960 Lizzadro
3,121,556 A 2/1964 Faulkner
3,195,694 A 7/1965 De Castro
3,691,712 A 9/1972 Bowling et al.
4,687,174 A * 8/1987 Helary ..... E04H 9/023 248/638
5,030,223 A * 7/1991 Anderson ..... A61B 90/11 600/383
5,301,480 A 4/1994 Oyama et al.
5,347,694 A * 9/1994 Perkins ..... F16B 21/10 24/632
5,364,214 A 11/1994 Fazekas
5,522,688 A 6/1996 Reh
5,533,307 A 7/1996 Tsai et al.
5,535,561 A 7/1996 Schuyler
5,540,530 A 7/1996 Fazekas
5,588,270 A 12/1996 Keating
5,815,999 A 10/1998 Williams
5,819,484 A 10/1998 Kar
5,845,438 A 12/1998 Haskell
5,880,037 A 3/1999 MacKarvich
5,915,676 A 6/1999 Abiru et al.
6,125,596 A * 10/2000 Goto ..... E04H 9/02 52/167.4
6,161,350 A 12/2000 Espinosa
6,195,949 B1 3/2001 Schuyler
6,224,521 B1 5/2001 Foucault
6,250,426 B1 6/2001 Lombard
6,390,747 B1 5/2002 Commins
6,494,654 B2 12/2002 Espinosa
6,560,940 B2 5/2003 Mueller
6,585,469 B2 7/2003 Commins
6,625,945 B2 9/2003 Commins
6,672,573 B2 * 1/2004 Berton ..... E04H 9/02 267/136
6,688,058 B2 2/2004 Espinosa
6,840,016 B1 1/2005 Mualla
6,892,504 B1 5/2005 diGirolamo et al.
6,931,804 B2 8/2005 Trarup et al.
6,951,078 B2 10/2005 Espinosa
7,007,432 B2 3/2006 Commins
7,017,312 B1 3/2006 Mueller
7,037,060 B2 5/2006 Commins
7,150,132 B2 12/2006 Commins
7,159,366 B2 1/2007 Espinosa
7,263,898 B1 * 9/2007 Martin ..... G01N 3/40 73/856
7,287,355 B2 10/2007 Commins
7,340,867 B2 3/2008 Espinosa
7,367,075 B2 5/2008 Kim
7,509,778 B2 3/2009 Leek
7,516,582 B2 4/2009 Leek
7,617,642 B2 11/2009 Espinosa
7,621,085 B2 11/2009 Commins
7,665,258 B2 2/2010 Espinosa
7,748,180 B1 7/2010 Plavidal
7,752,824 B2 7/2010 Brown et al.
7,762,030 B2 7/2010 Espinosa
7,905,066 B2 3/2011 Pryor et al.
7,971,411 B2 7/2011 Commins
8,001,734 B2 8/2011 Pryor et al.
8,112,955 B2 2/2012 Espinosa
8,136,318 B2 3/2012 Espinosa
8,186,924 B1 5/2012 Espinosa
8,276,323 B2 10/2012 Gray et al.
8,511,019 B2 8/2013 Espinosa
8,621,791 B2 1/2014 Mualla
8,656,650 B2 2/2014 Gray et al.
8,677,699 B2 3/2014 Tagawa
8,789,319 B2 * 7/2014 Li ..... E04B 1/98 188/378
8,844,244 B2 9/2014 Gray et al.
8,857,110 B2 10/2014 Constantinou et al.
8,881,478 B2 11/2014 Gray et al.
9,080,339 B2 7/2015 Hayes
9,097,000 B2 8/2015 Espinosa
9,206,616 B2 12/2015 Sarlis et al.
9,580,924 B1 2/2017 Taylor et al.
9,587,401 B1 3/2017 Benton
9,938,714 B2 4/2018 Dicaire
2001/0045069 A1 11/2001 Constantinou
2002/0129568 A1 9/2002 Oka
2002/0140266 A1 * 10/2002 Broekhuis ..... A47C 3/265 297/353
2003/0230032 A1 12/2003 Shahnazarian et al.
2004/0107654 A1 6/2004 Powell et al.
2005/0284057 A1 12/2005 Commins
2006/0133912 A1 6/2006 Commins
2006/0269364 A1 11/2006 May
2008/0060296 A1 3/2008 Espinosa
2012/0304589 A1 12/2012 Commins
2015/0184413 A1 7/2015 Pryor
2017/0144714 A1 * 5/2017 Dupay ..... B62D 53/0814
2017/0145686 A1 5/2017 Lee et al.

FOREIGN PATENT DOCUMENTS

CN 107044123 A 8/2017
EP 0516314 A2 12/1992
EP 0808965 B1 8/2003
GB 1133315 11/1968
JP 201262928 A 3/2012

* cited by examiner

BUILDING SHRINKAGE COMPENSATION DEVICE WITH ROTATING GEARS

CROSS-REFERENCE TO RELATED APPLICATION

This application is a continuation-in-part of U.S. patent application Ser. No. 15/922,041, which is a continuation of U.S. patent application Ser. No. 15/468,610, now U.S. Pat. No. 9,938,714, which claims priority to U.S. Provisional Application No. 62/312,514, filed Mar. 24, 2016, the entire contents of which are hereby incorporated by reference.

BACKGROUND

The disclosure relates generally to building structures, and more particularly to shrinkage compensation devices for building structures having wooden frames.

In wood constructions, such as residences and smaller commercial buildings or hotels, the wood construction material naturally shrinks slightly over time. Shrinkage in lumber occurs as the moisture in the wood members evaporates causing the wood materials to constrict. Since only the wooden materials shrink (not fasteners or other metal components), the shrinkage of the building materials and the heavy load weight of building materials can result in an undesirable extra vertical clearance between levels and an overall loose structure. This phenomenon commonly causes the building to be susceptible to damage from uplift due to high winds or similar external forces. Thus, building compensation devices exist to restrain the building materials and prevent uplift. A typical system includes a series of elements; connectors at the roof to top of a wall, top of a wall to vertical studs, vertical studs between adjacent floors and to the foundation. In order to counteract upward loads from winds, the framing members may be anchored to the surface on which they are supported. On the ground level, anchor rods are typically sunk into a concrete foundation, and the bottom plate of the wall is bolted to the anchor rods. For levels built on top of the first level, straps or elongate fasteners are often used to anchor an upper level to the level below.

While effective at anchoring upper levels to lower levels, coil straps have certain drawbacks, including being positioned on the exterior of a framed construction, requiring alignment of vertical studs on adjacent floors Shrinkage in lumber occurs as the moisture in the wood members evaporates causing the members to constrict. This constriction may result in buckling or bowing outward of the strap, as well as any siding or exterior covering of the framed construction.

Compensation or take-up devices exist that allow a screw or similar elongate fastener to travel in one direction relative to a building level, while preventing the screw from traveling in the other direction exist for this reason. In practice, for example, a compensation device having a plate or similar element may be attached to the frame of an upper level of a building structure. An elongate fastener may be driven through the upper level frame with the distal end secured to the frame in the lower level. The compensation device in this example would allow the proximal end of the fastener (head) to travel upward relative to the top level frame, but prevent it from moving in the opposite direction.

Shrinkage compensation devices are shown and described in the art, including devices that mechanically engage with threads in the proximal portion of the elongate fastener to maintain the fastener with a ratchet engagement. Other devices exist that employ a torsion spring that biases two threaded members in opposite rotational directions so that the device can expand but not contract, or vice versa, depending on the position within the building frame structure. These known devices carry several drawbacks, including that the required firm mechanical metal-on-metal contact with the threads in the former example provides resistance in the direction of travel and can leave the threading vulnerable to stripping, as well as the strength of the ratchet engagement being limited by the shallowness of the threading. The rotationally biased devices can be prone to malfunction due to complexity and typically require several distinct steps during installation, making them inconvenient. Thus, there is a need for a building shrinkage compensation device that is easy to install and reduces or omits all of the aforementioned drawbacks.

SUMMARY

In an embodiment, a building shrinkage compensation device has a base plate defining an intermediate hole laterally between opposite ends. The base plate includes a plurality of teeth laterally spaced from one another. An elongate fastener extends axially through the hole. At least one gear member includes a plurality of teeth circumscribing its outer periphery that are configured to engage with the teeth in the base plate. The gear member is axially fixed and rotationally pivotable relative to the fastener.

BRIEF DESCRIPTION OF THE DRAWINGS

Aspects of the preferred embodiment will be described in reference to the drawings, where like numerals reflect like elements.

DETAILED DESCRIPTION

Figure 1:
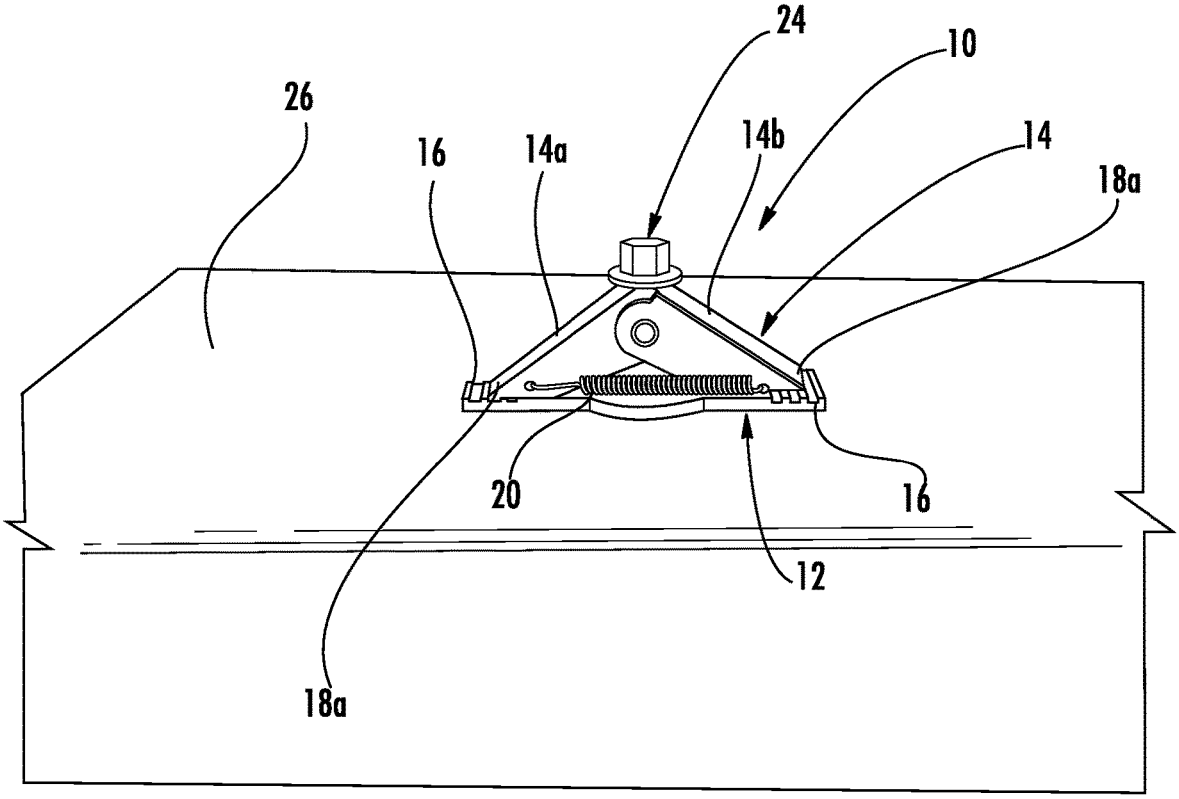
FIG. 1 depicts an embodiment of the building shrinkage compensation device installed on an upper level board in a collapsed position.

Among the benefits and improvements disclosed herein, other objects and advantages of the disclosed embodiments will become apparent from the following wherein like numerals represent like parts throughout the several figures. Detailed embodiments of a hinged building shrinkage compensation device are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrases "In some embodiments" and "in some embodiments" as used herein do not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on.

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

With reference to the Figures, disclosed herein is a ratcheted building shrinkage compensation device 10 having an elongate base plate 12 and a hinged expander 14. The base plate 12 has a plurality of spaced notches defined between a series of teeth 16 on opposite lateral ends. As shown, the hinged expander 14 is mounted on the base plate 12 with opposite edges 18*a* and 18*b* configured to engage within a notch on the respective lateral ends of the base plate. An expanded spring 20 extends between opposite ends of the hinged expander 14 and is connected to each leaf (14*a* and 14*b*) of the expander 14 to provide moderate inward biasing forces on each lateral end 18*a* and 18*b* of the of the expander 14. Shown best in FIGS. 2 and 3, the base plate 12 defines a hole 21 in its body intermediate the respective series of teeth 16. The hinged expander also defines a hole 22 at its apex between the respective leafs 14*a* and 14*b*. The expander 14 is mounted on the base plate 12 with the holes (21 and 22) aligned, thereby defining a passage for attachment of a take-up fastener 24 (i.e., screw or similar).

Reference numeral 26 represents a generally flat or horizontal upper level of a building structure (frame or similar). Typically, the hinged expander 14 is initially mounted in its collapsed position on base plate 12 (i.e., with opposite leaf edges 18*a* and 18*b* engaged in an outer notch). Notably, in the collapsed position of the expander 14, the tension spring 20 is actually extended or expanded with a higher degree of tension biasing the respective leafs 14*a* and 14*b* inward. The compensation device is secured to the surface of the upper level 26 via compressive forces of the proximal head 28 of the take-up fastener 24, with the distal end of the fastener 24 secured to the lower building level 27. As shown, the fastener 24 is positioned extending through the passage defined by the holes (21 and 22) in the apex of the hinged expander 14 and the base plate 12, and driven through the upper level 26 and into the lower level 27 of the building frame, securing the upper level to the lower level (see full structure FIG. 9) with the compensation device 10 compressed between the fastener head 28 and the upper level 26. As shown, a flange 25 near the proximal head 28 of the take-up fastener tightly abuts the edges of the hole 22 of the hinged expander 14 when installed. At least a proximal portion of the shank of the take-up fastener 24 is unthreaded such that there is no threaded engagement between the take-up fastener 24 and any of the base plate 12, hinged expander 14 and the upper level plank 26 (i.e., the proximal portion of the take-up fastener shank may pass freely through these elements). As shown in the representative structure FIG. 9, the take-up fastener 24 has threading 30 toward the distal end of the shank to engage securely into the lower level plank 27. That is, the take-up fastener 24 and lower level plank 27 are rigidly attached at installation, while the take-up fastener 24 is longitudinally reciprocable relative to the upper level plank 26.

Once installed, the tension spring 20 provides an inward bias on the outer edges 18*a* and 18*b* of the leafs 14*a* and 14*b*, which in turn biases the head 28 of the take-up fastener longitudinally upward relative to the upper level 26 and attached base plate 12. The upward bias on the take-up fastener head and secure attachment of the take-up fastener to the lower level plank 27 results in a relative bias on the upper level plank 26 and lower level plank 27 toward each other. While the tension spring 20 biases the opposite outer edges 18*a* and 18*b* of the leafs 14*a* and 14*b* inward, the surfaces and configuration of the notches and teeth 16 are such that outward movement of the edges 18*a* and 18*b* is prevented (i.e., only inward movement of the outer edges is permitted, thereby preventing further collapsing of the expander and take-up fastener head). As a result, the upper and lower levels can only be tightened relative to one another.

As described above, over time, wood building materials may undergo natural shrinkage and constriction due to moisture loss, and settlement due to the weight of the materials. As shrinkage occurs, the upward bias on the take-up fastener head 28 keeps the upper level and lower level building materials in a tight arrangement relative to one another, resisting any upward loads on the building (from high winds, for example). The hinged expander 14 is allowed to "expand" upward via inward spring bias on the leaf edges 18*a* and 18*b* to maintain a tight system, while also being mechanically prevented from collapsing (by outward movement of the leaf edges 18*a* and 18*b*). Once the wood materials shrink enough that one or both of the leaf edges 18*a* and 18*b* pass from a notch inwardly over a tooth 16, the edges are maintained in the adjacent notch and prevented from moving outward again. In this manner, the shrinkage compensation device 10 allows one-way motion of the base plate 12 and secured top level plank 26 relative to take-up fastener 24 and lower level 27 to compensate for the shrinkage of the wooden building materials to maintain the building structure in a tight arrangement. This one-way motion allows the wood building materials to constrict and the take-up fastener 24 to "take up" the lower level 27 relative to the upper level 26, while preventing upward movement of the building materials under an upward force. The disclosed shrinkage compensation device 10 may be used to attach subsequent levels in a building structure to the adjacent level below; the device and described methods are not limited to a two-level structure. Furthermore, as skilled artisans will readily appreciate, the positioning of the expander 10 on the top surface of an upper level can be reversed to a bottom fastener driven upward into the upper level.

The disclosed shrinkage compensation device 10 provides a simple installation and improved performance over known devices due to free passage of the proximal portion of the shank of the take-up fastener through the upper level plank and hole 21 in the base plate 12 (i.e., an absence of a metal-on-metal engagement with a take-up fastener threading during operation). In this manner, the compensation device 10 allows the proximal portion of the take-up fastener to travel freely upward relative to the upper level 26 as the wood building material shrinks.

In an alternate embodiment, not depicted herein, the laterally-extended tension spring 20 is replaced by a bias member positioned between the base plate 12 and hinged expander 14 directly biasing the apex of the hinge upward. The bias member in this embodiment can be, for example, a compressed spring or another elastic material.

Figure 2:
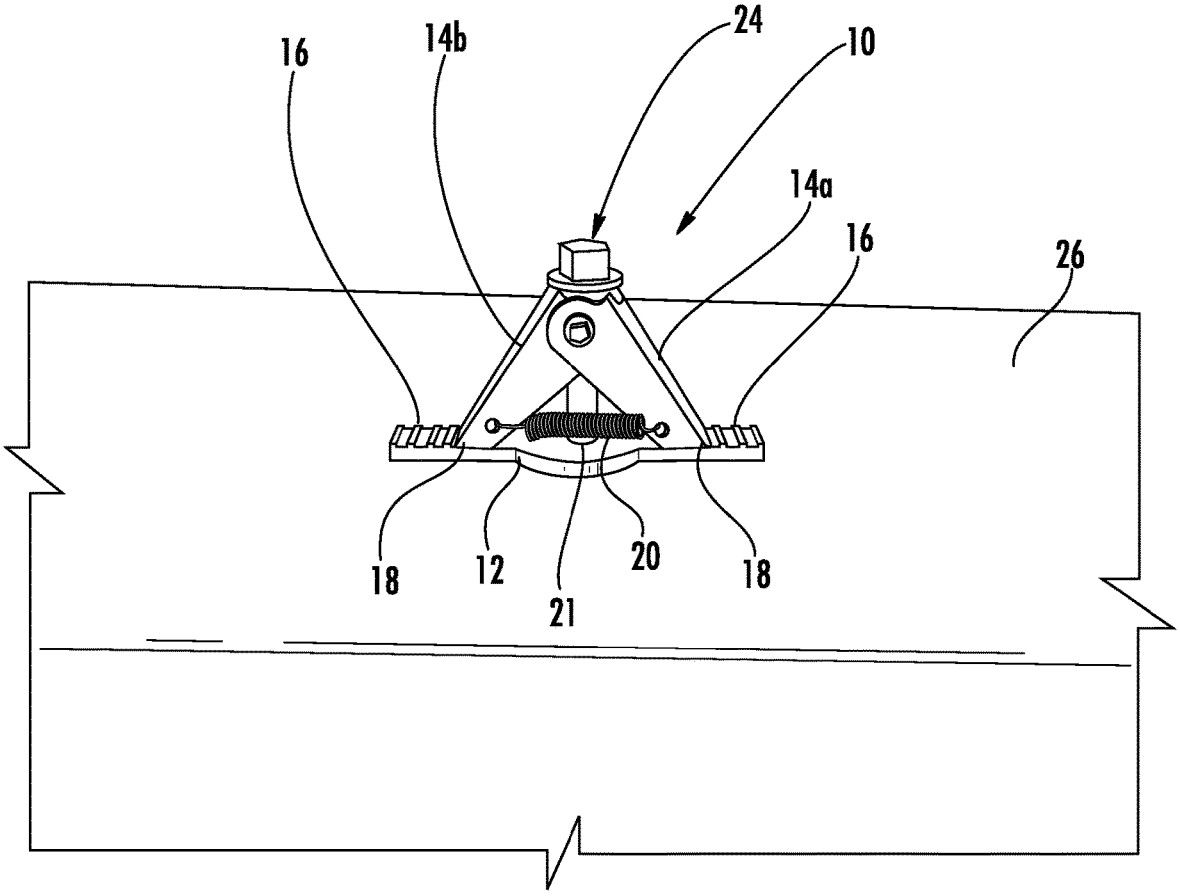
FIG. 2 depicts the compensation device of FIG. 1 in an expanded position.
Figure 3:
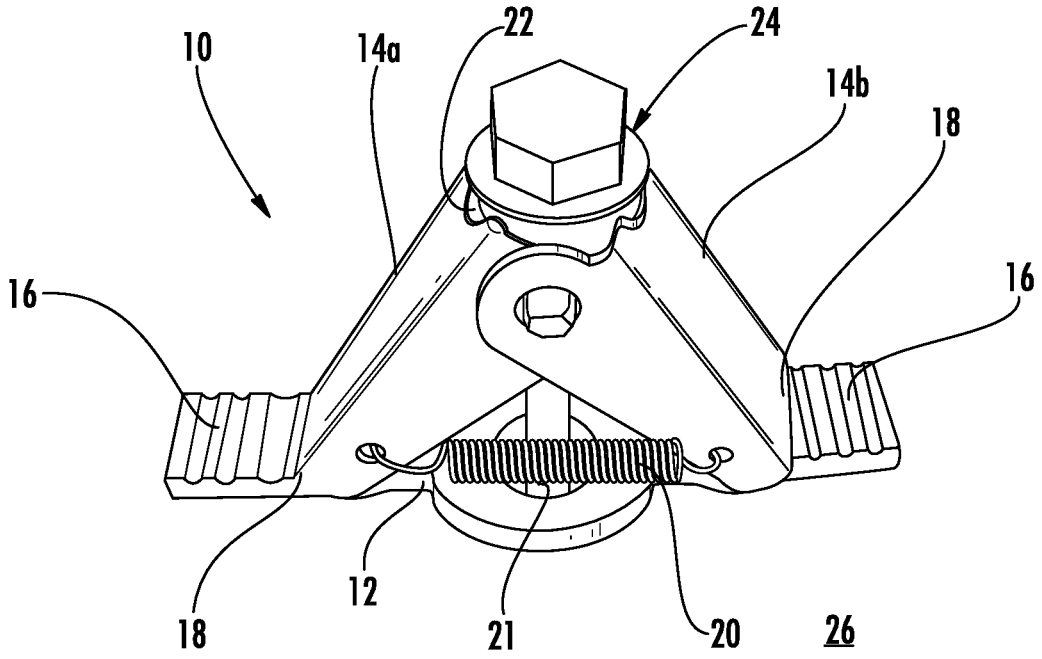
FIG. 3 is an enlarged view of the expanded compensation device of FIG. 2 from a different angle.

Generally, FIG. 1 depicts the device 10 with the hinged expander 14 in an initial collapsed position with outer leaf edges 18 in outer grooves in the base plate 12. The depiction of FIG. 1 represents the typical configuration at the point of initial installation of the device 10. FIG. 2 depicts the device 10 after shrinkage of the building materials has occurred and the spring 20 has contracted the outer leaf edges 18*a* and 18*b* inward causing upward movement of the apex of the hinged expander 14 and head 28 of the take-up fastener 24 relative to the base plate 12 and upper level plank 26. As shown, the edges 18*a* and 18*b* are maintained in base plate grooves that are inward of the grooves that maintained the edges initially and the expander apex and take-up fastener head are raised from the base plate and upper level plank. FIG. 3 is an enlarged view of the FIG. 2 condition from a different view, showing the tension spring 20, teeth 16 and intermediate grooves in greater detail.

Figure 4:
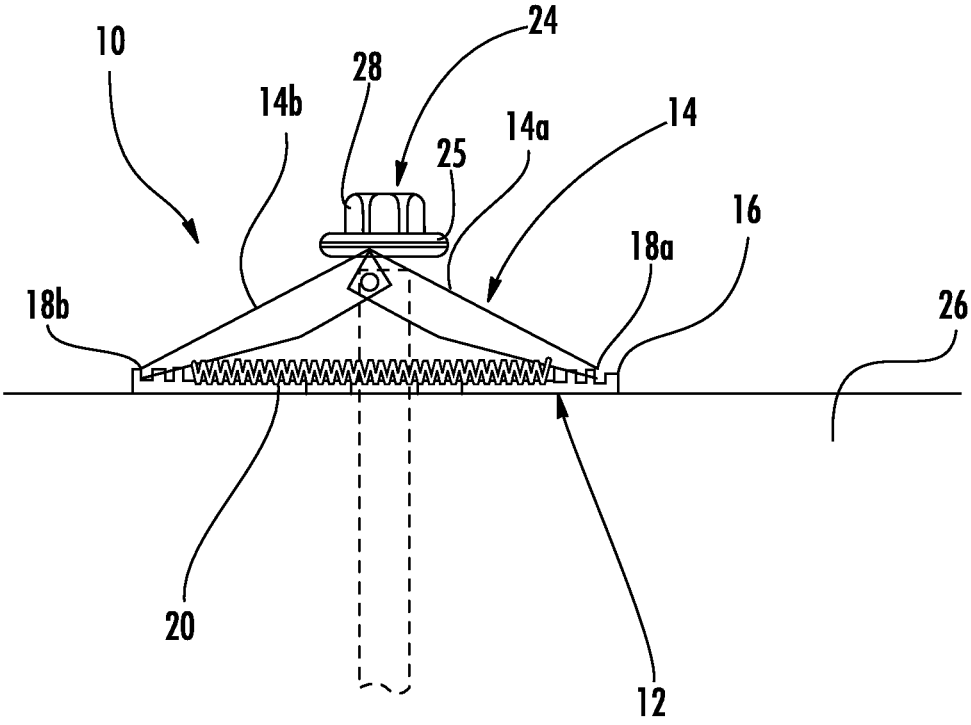
FIG. 4 is a side elevation view of an embodiment of the compensation device in a collapsed position at initial install.

FIG. 4 shows an embodiment of the shrinkage compensation device 10 with the hinged expander 14 in the collapsed position just after installation. The spring 20 attached to the opposite leafs 14*a* and 14*b* is stretched and under tension and the outer edges 18*a* and 18*b* of the leafs 14*a* and 14*b* are locked by outer teeth 16.

Figure 5:
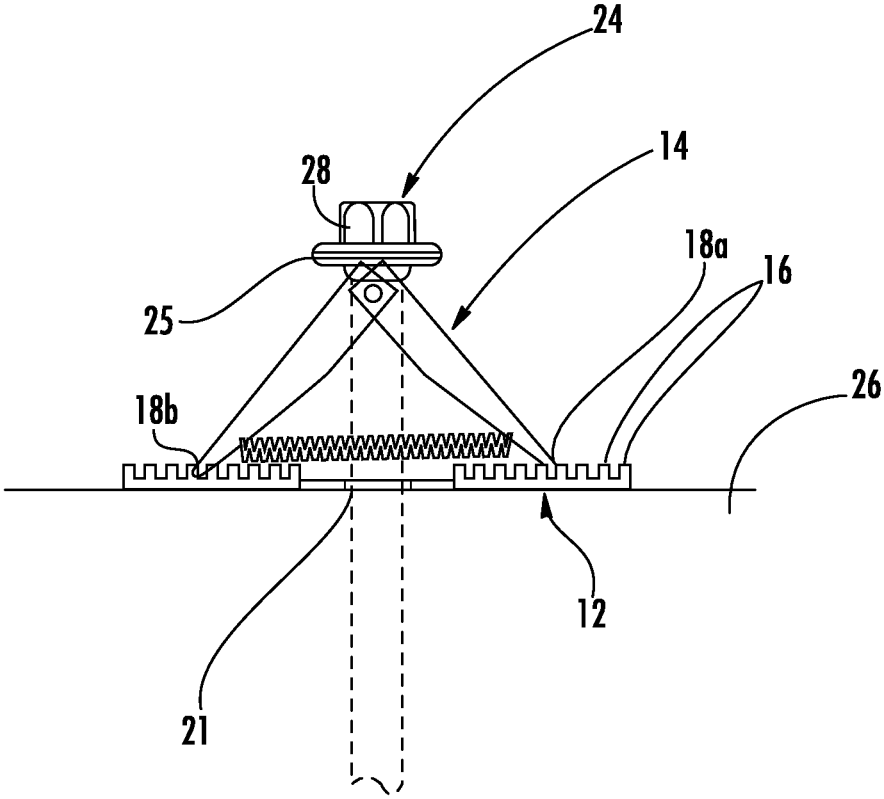
FIG. 5 is a side elevation view of the device of FIG. 4 in an expanded position after shrinkage of building materials.

FIG. 5 shows the shrinkage compensation device 10 after shrinkage of building materials with the expander 14 in an upwardly expanded position and greater clearance between the fastener head 28 and upper level plank 26. The spring 20 has contracted relative to its position in FIG. 4, thereby drawing the leafs 14*a* and 14*b* inward and pushing the apex of the hinged expander 14 upward and raising the take-up fastener 24 relative to the top level 26 to compensate for the natural shrinkage of the building material. The outer edges 18*a* and 18*b* of the respective leafs 14*a* and 14*b* are locked by teeth positioned inward of teeth locking the edges in the collapsed position (FIG. 4).

Figure 6:
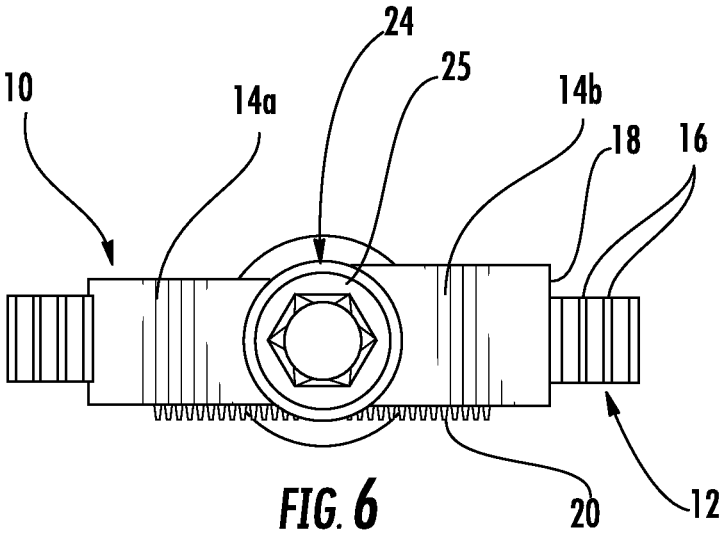
FIG. 6 is a top elevation view of the device of FIG. 5.
Figure 7:
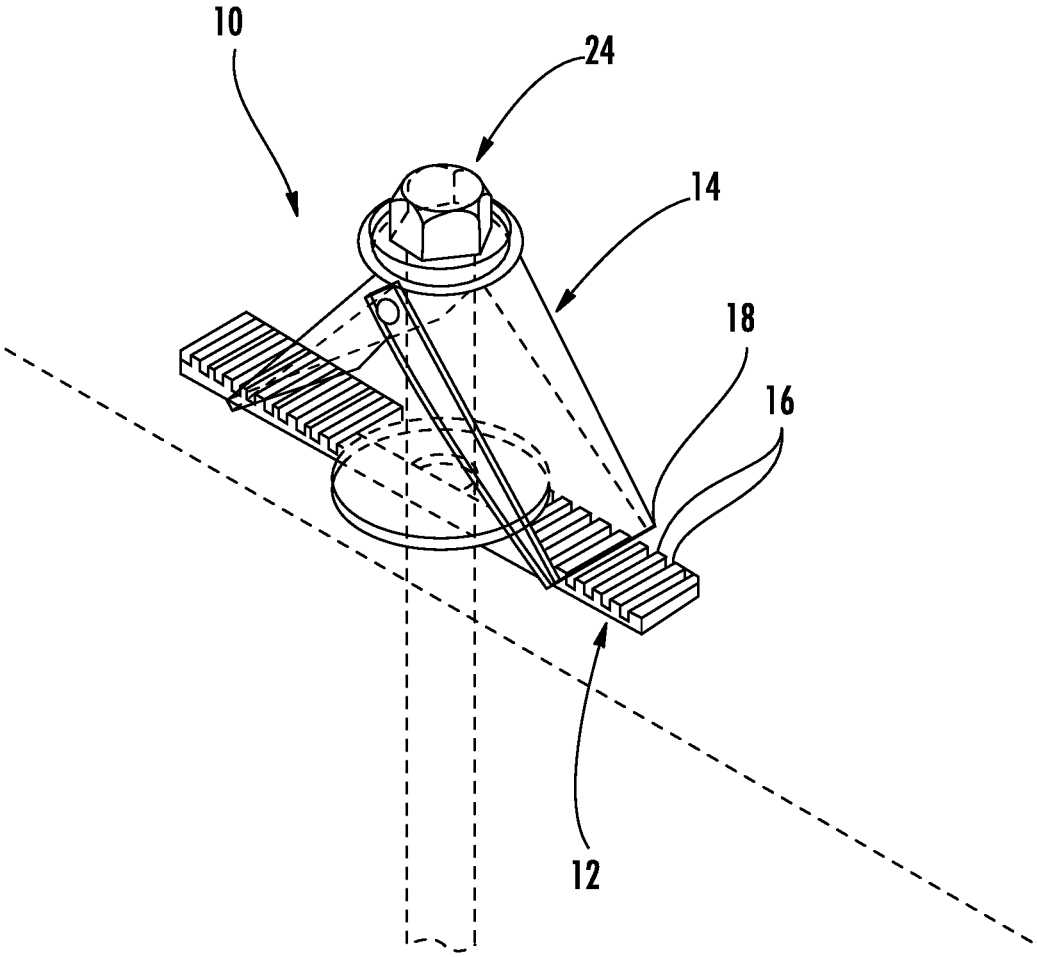
FIG. 7 is an isometric perspective view of the device of FIG. 5.

FIG. 6 is a top view of the compensation device 10 in the expanded configuration shown in FIG. 5. FIG. 7 shows an isometric view of the compensation device 10 in the expanded configuration shown in FIG. 5.

Figure 8:
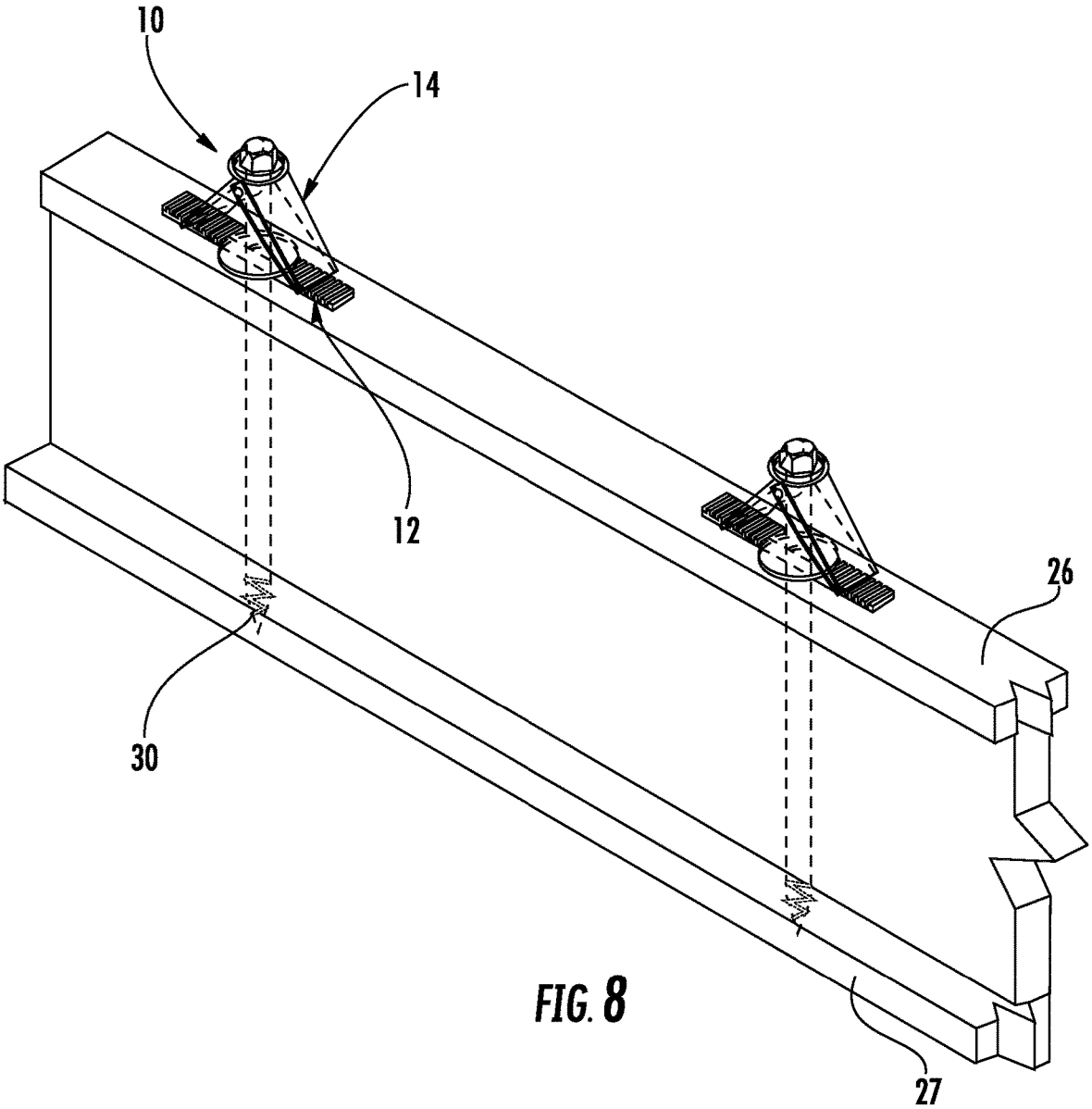
FIG. 8 depicts a representative building structure with the disclosed compensation device installed in its initial collapsed position.

FIG. 8 shows a representative building structure with the compensation device 10 in the raised/expanded position (like in FIGS. 2 and 5). When initially installed, the take-up fastener 24 is driven through the passage defined by the holes in the apex of the hinged expander 14 and the base plate 12 through the upper level board 26 and into the lower level 27 (representative elements may not be drawn to scale).

Preferred embodiments of the base plate 12 are made from galvanized steel of around 10-gauge thickness having a length between approximately 1.5 and 5 inches. Larger devices for use with rod securement can be up to 12 inches long. Preferred embodiments of the hinged expander 14 are made from galvanized steel of approximately 14-20 gauge thickness.

In a typical building structure, shrinkage compensation devices 10 are secured to respective upper level frames in the manner described above approximately 6-60 inches apart. In some areas of building structures, like near a corner post, it may be desirable to secure two compensation devices right next to each other, for example, at approximately 2 inches apart off-center. Of course, all of the preferred materials, dimensions and installation characteristics disclosed herein are non-limiting to the inventive concept.

Figure 9:
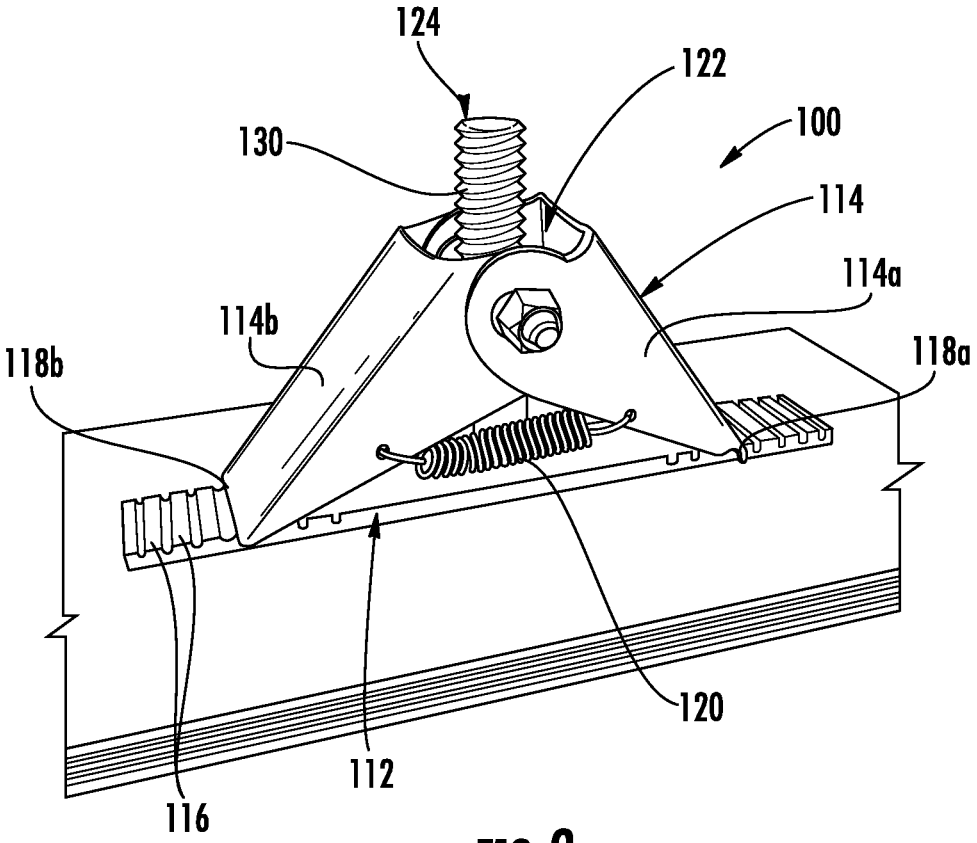
FIG. 9 shows another embodiment of the disclosed hinged building shrinkage compensation device.
Figure 10:
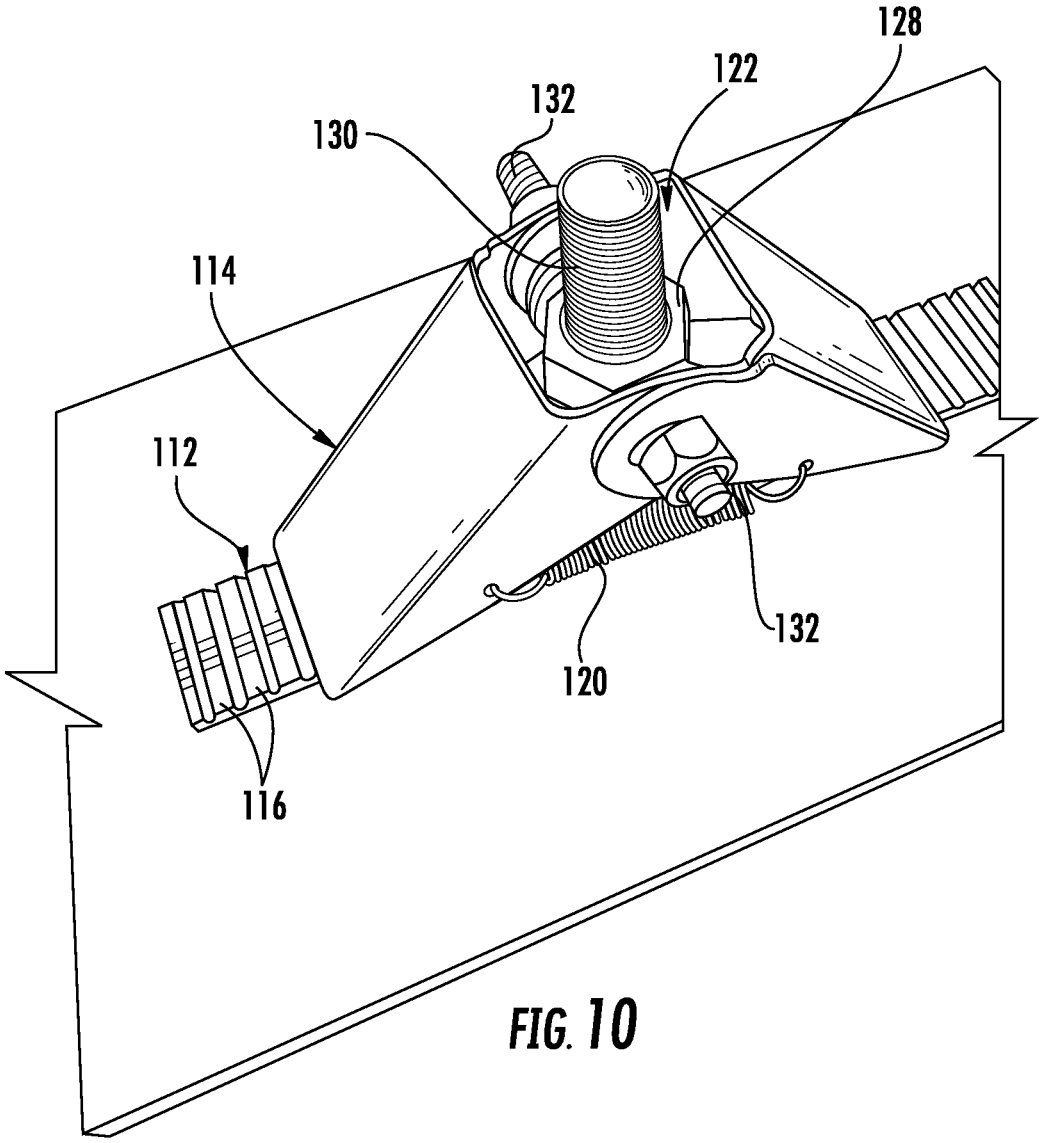
FIG. 10 shows another view of the device of FIG. 9.
Figure 11:
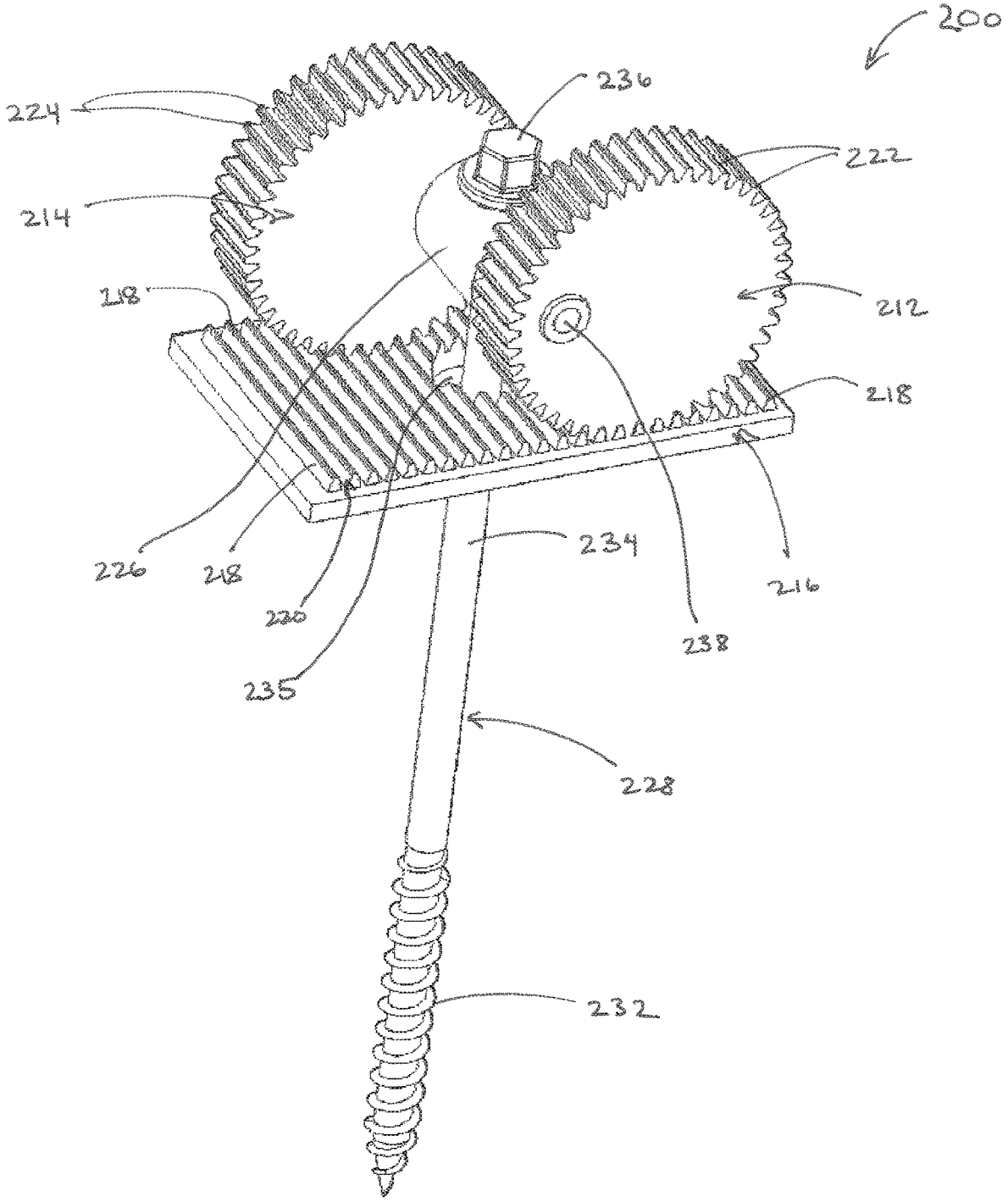
FIG. 11 shows another embodiment of a building shrinkage compensation device.
Figure 12:
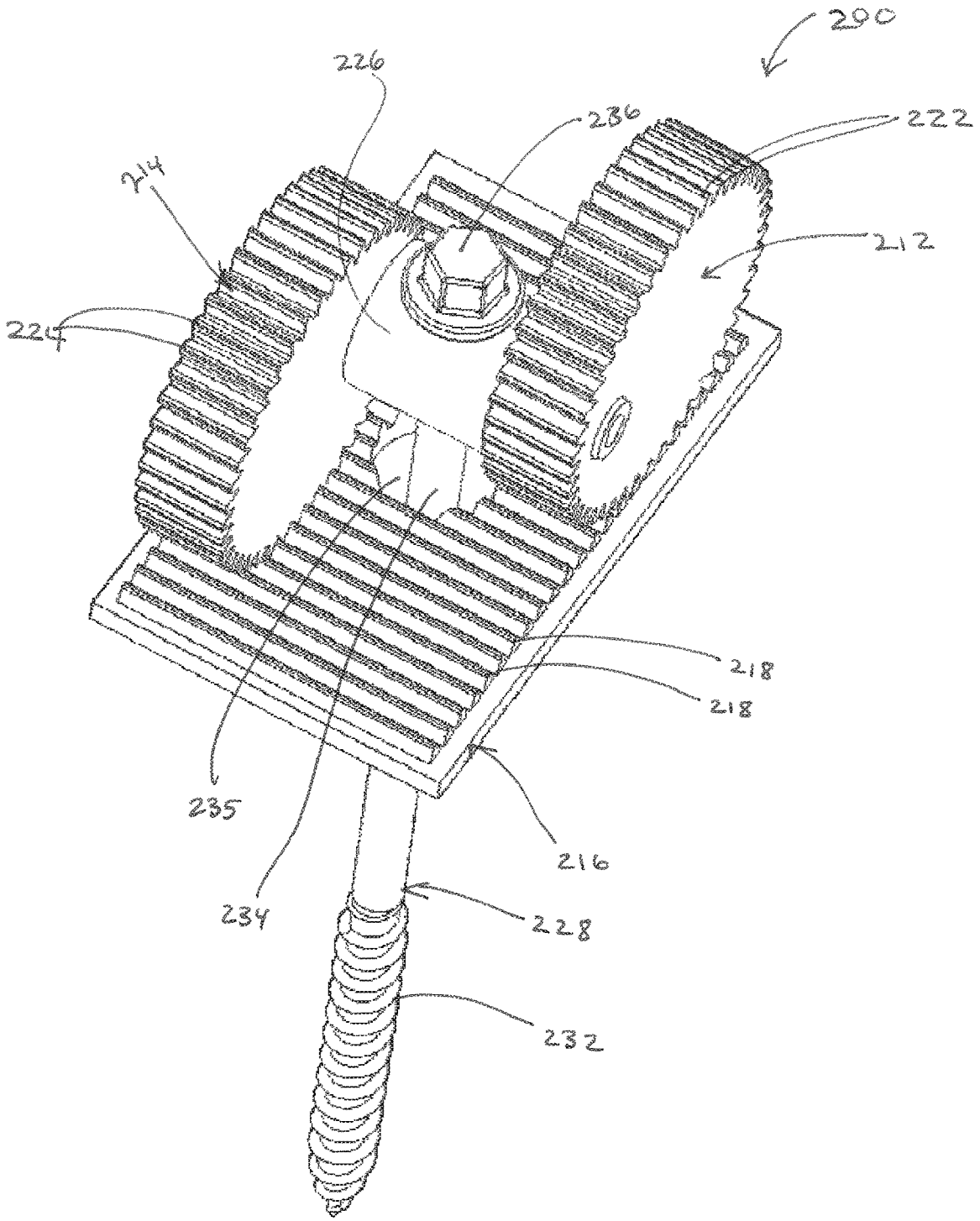
FIG. 12 shows another view of the embodiment of FIG. 11.

With reference to FIG. 9, another embodiment of a hinged building shrinkage device 100 is disclosed. In most respects, the device 100 includes the similar elements and relationships, and operates in a similar way as compared to the prior embodiment of the device 10. The device 100 includes an elongate base member 112 with a series of spaced teeth 116 on each of the opposite lateral ends. A hinged expander 114 with cooperative leafs 114*a* and 114*b* is mounted on the base member 112 with outer edges 118*a* and 118*b* of the leafs configured to engage with a notch between adjacent teeth 116. An expanded compression spring 120 is attached to opposite leafs 114*a* and 114*b* biasing them toward one another. An opening 122 is defined in the apex portion of the hinged expander 114 between the respective leafs.

In this embodiment, a takeup fastener 124 has a threaded outer surface 130 at least proximate an upper end. An inner nut 128 is fastened to the hinge leafs 114*a* and 114*b* via a pair of cross bolts 132, and defines a threaded bore to engage with the threads 130 in the takeup fastener 124. The hinged expander 114 is brought to its expanded position via rotation around the threads 130 of the takeup fastener in the direction to draw the apex of the expander 114 downward until the device is tightened with outer edges 118*a* and 118*b* of the leafs 114*a* and 114*b* within a notch of the base member 112. Once the device 100 is tightened in a collapsed position, it operates just like the embodiment of the device 10. As building materials shrink, the inward bias on the opposite leafs 114*a* and 114*b* via the spring 120 biases the apex portion of the expander 114 upward. Instead of biasing the takeup fastener upward via abutting with a head (like the head 28 of the previous embodiment), the take-up fastener 124 is continuously biased upward via the threaded engagement between inner nut 128 and threads 130.

FIGS. 11-17 show another embodiment of a takeup device 200 that includes a pair of offset gears, 212 and 214. In this device 200, a base plate 216 extends laterally between opposite edges and includes a plurality of spaced apart teeth 218 defining locking notches 220 between adjacent teeth 218. In this embodiment, the teeth 218 are spaced the entire lateral extent of the base plate 216 to accommodate the toothed gears, 212 and 214. Each of the gears 212/214 includes series of spaced apart teeth 222 and 224, respectively, about its entire circumference. The gear teeth 222/214 are sized and shaped to be received within the notches 220 between the teeth 218 in the base plate, such that each gear 212/214 can roll or rotate laterally over one tooth 218 after another along the base plate 216, as will be discussed in detail below.

The gears 212 and 214 are attached to one another via an intermediate sleeve 226 that is fixed to the shank 230 of an elongate fastener 228. As with the earlier embodiments, the fastener 228 includes threading 232 at least on a distal portion of the shank 230. The fastener shank 230 is longitudinally fixed relative to the gears 212/214 via the sleeve 226, but can freely pass through a hole 235 in the base plate 216.

As shown, the gears 212 and 214 are substantially parallel to one another, but not coaxial. Each gear, 212 and 214, is engaged with the sleeve 226 in a rotational attachment via a perpendicular pin, 238 and 239, respectively, at offset position offset from the central axis of the respective gear 212/214. This creates a rotational axis $A_1$ and $A_2$ that is parallel to, but not along the central axis of each gear 212 or 214. Bearings, bushings or other similar elements known in the art may be included for reduction of friction during rotation. The axes, $A_1$ and $A_2$, are parallel to one another, and in the depicted preferred embodiment, are substantially coaxial.

Figure 13A:
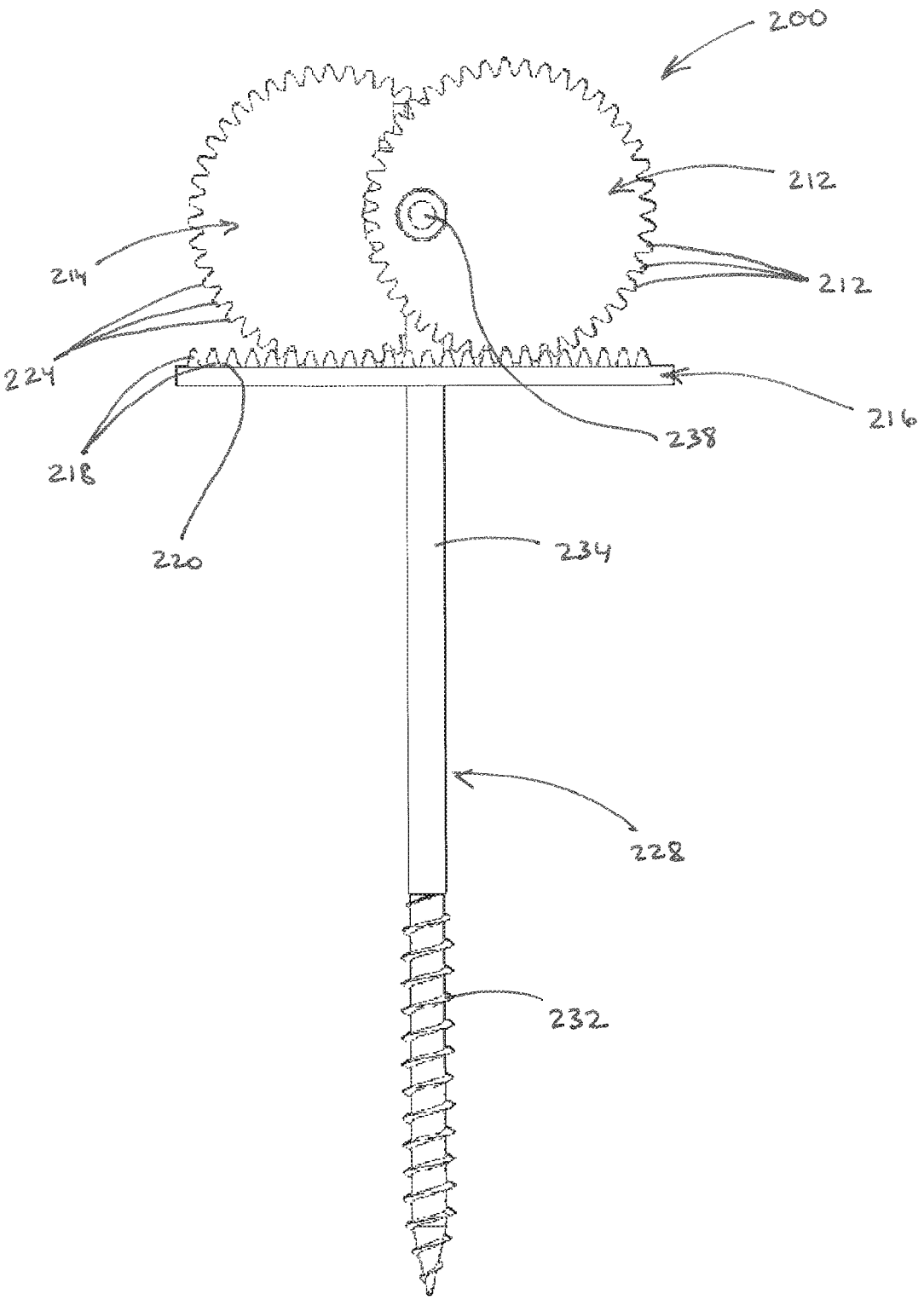
FIG. 13A is a side perspective view of the embodiment of FIG. 11 in a raised position.
Figure 13B:
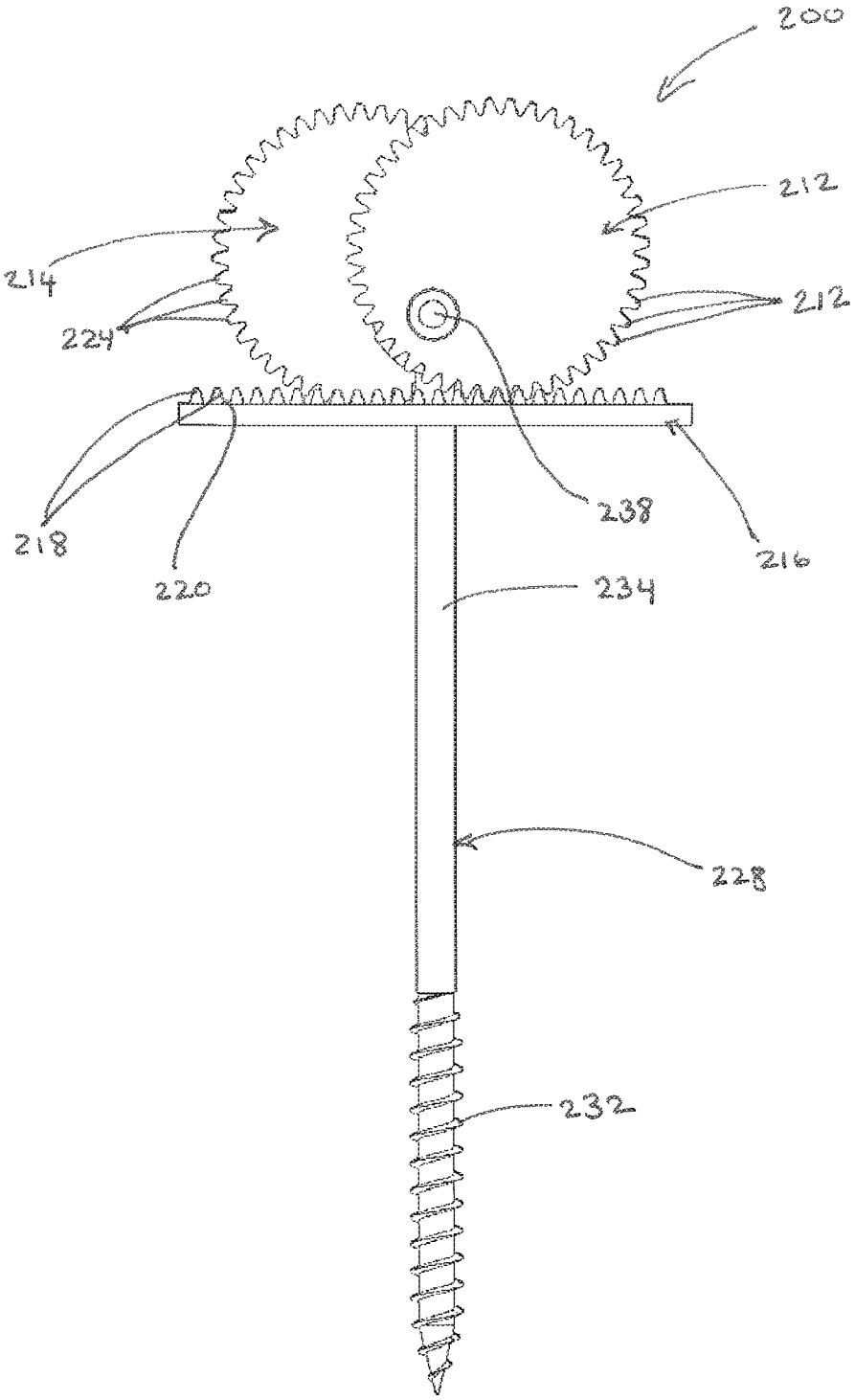
FIG. 13B is a side perspective view of the embodiment of FIG. 11 in an initial installation position.
Figure 14:
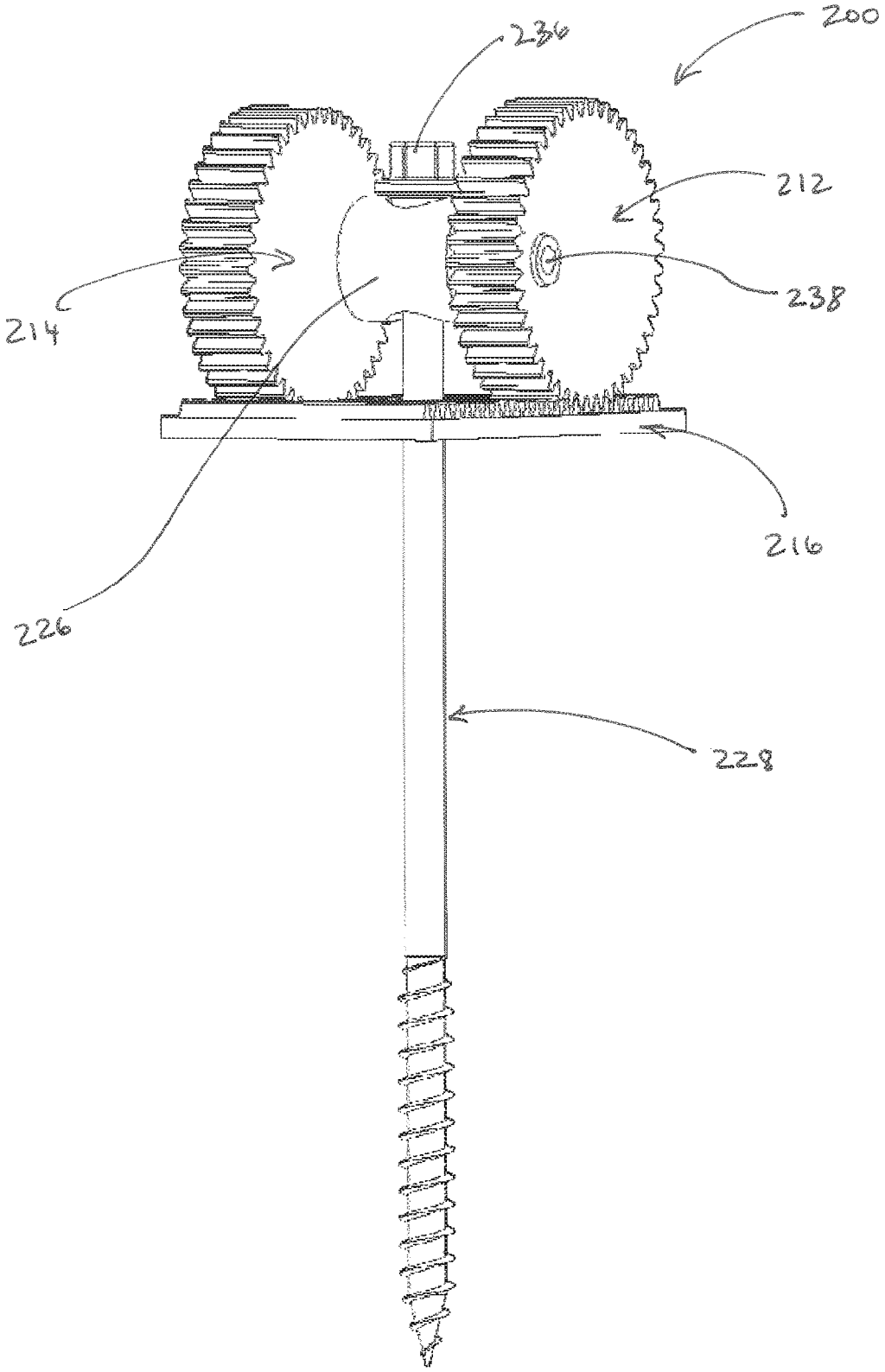
FIG. 14 is a corner perspective view of the embodiment of FIG. 11.
Figure 15:
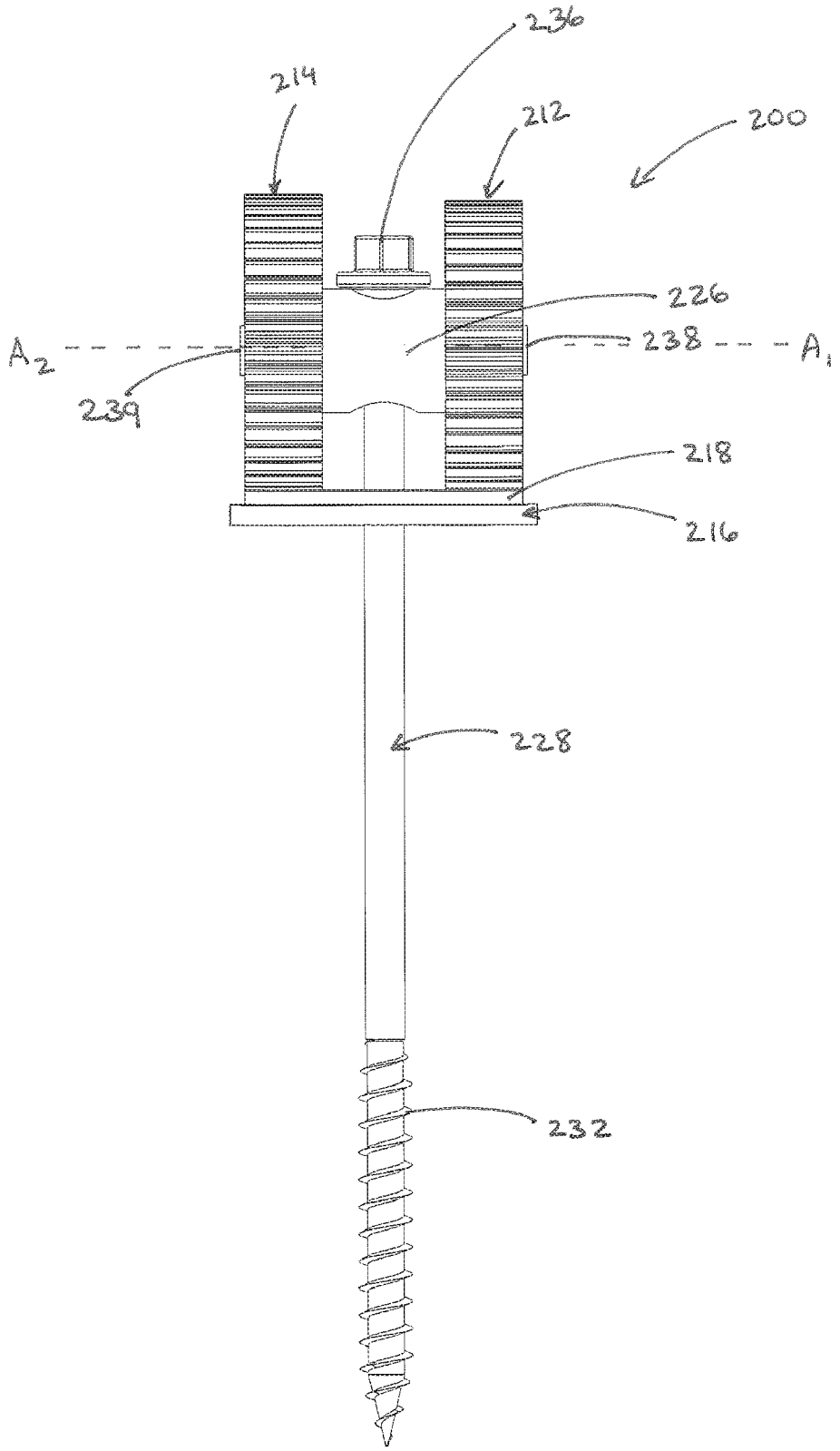
FIG. 15 is a front perspective view of the embodiment of FIG. 11 in the raised position.
Figure 16:
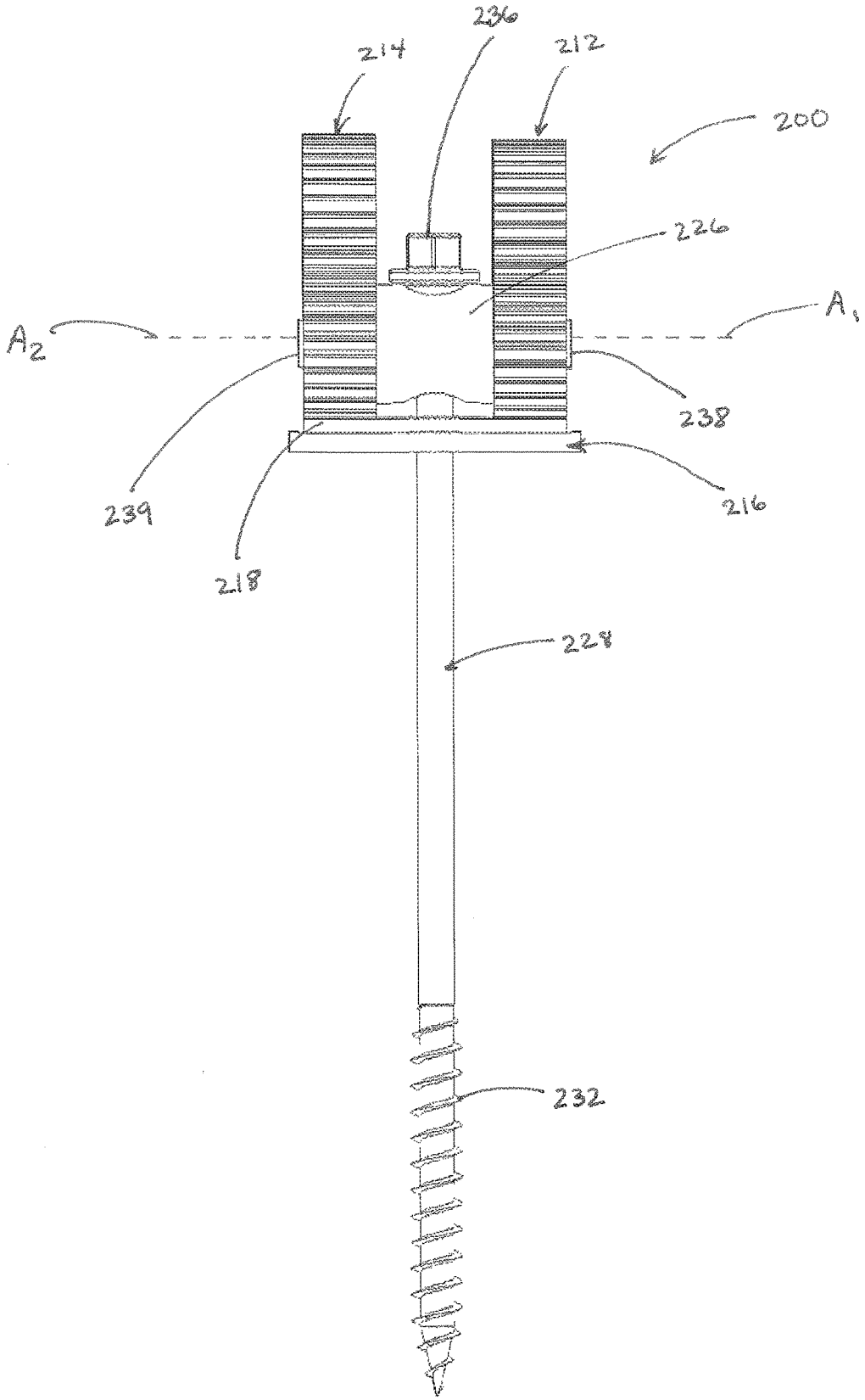
FIG. 16 is a front perspective view of the embodiment of FIG. 11 in the initial installation position.
Figure 17:
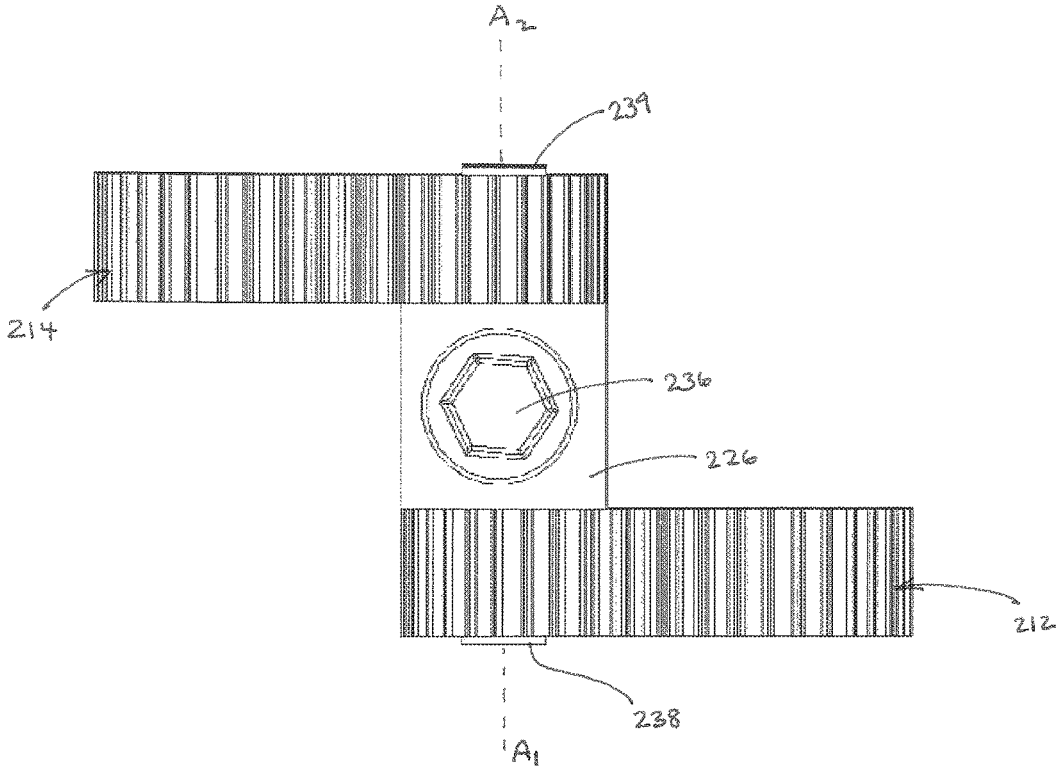
FIG. 17 is a top perspective view of the embodiment of FIG. 11.

In a typical operation, the base plate 216 is first secured to an upper level of a building structure (like that shown as reference numeral 26 in FIG. 8). A bore may be pre-drilled in the upper surface aligned with the base plate hole 235 or the fastener 228 can driven through the upper surface at the position of the hole 235 and then securely into the lower surface (like that shown as reference numeral 27 in FIG. 8). In this installed position with the threaded distal portion 232 of the shaft secured to the lower level (i.e., fixed in the axial direction), the unthreaded proximal portion 234 can pass freely through the hole 235 in the base plate and upper level. The teeth 222/224 of gears 212/214 are engaged with the teeth 218 in the base plate 212 and the head 236 of the fastener at its lowermost point, as depicted in FIGS. 13B and 16. In this initial installation position, the gears 212/214 are each rotationally aligned with their rotational axes, $A_1$ and $A_2$, centrally located in the lateral direction.

In this embodiment 200, when the device is installed, as the building materials naturally shrink due to moisture loss, the upper level with attached base plate 216 will naturally sink lower (toward the lower level). The fastener 228 is axially fixed relative to the lower level and freely movable axially relative to the upper level, so the head 236 will rise relative to the upper level as the upper level sinks. This causes the pins 238 to rise relative to the base plate 216 along with the head 236 of the fastener, thereby causing the gears 212/214 to rotate. In the side view of FIG. 13A, the first gear 212 will have rotated clockwise and the second gear 214 would have rotated counterclockwise along the teeth 218 in the base plate 216 to the raised position depicted. The front view of FIG. 15 also shows the raised position compared to the view of the initial installed position shown in FIG. 16. Since the rotational axes, $A_1$ and $A_2$, are offset from the central axis of each gear, 212 and 214, the angular displacement of the gears mechanically locks the fastener in the raised position (or locks the upper level in its lower position relative to the head 236).

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed is:

1. A building shrinkage compensation device, comprising:

a base defining an intermediate hole laterally between opposite ends and a plurality of teeth laterally spaced from one another;

an elongate fastener extending longitudinally through the hole;

a locking member mounted on the base plate with edge portions engaged with teeth in the base, wherein the locking member is longitudinally fixed relative to the fastener, the locking member comprises at least one round gear member with a central axis and a plurality of teeth circumscribing an outer periphery configured to engage with the teeth in the base, the gear member is longitudinally fixed and rotatable relative to the fastener, and the gear member is rotatable about a single fixed axis that is offset from the central axis.

2. The building shrinkage compensation device of claim 1, wherein the base plate is fixed to a surface of a first building member and the elongate fastener includes a proximal head and distal threading that is secured to a second building member spaced away from the first building member.

3. The building shrinkage compensation device of claim 1, wherein the elongate fastener passes freely through a hole in the first building member that is aligned with the hole in the base plate.

4. The building shrinkage compensation device of claim 3, wherein when one or both of the first building member and second building member shrinks, the at least one gear member rotates along the base plate, causing a longitudinal distance between the fastener head and base plate to increase.

5. The building shrinkage compensation device of claim 4, wherein the at least one gear member comprises two gear members, both gear members rotate about a respective axis, and the respective axes of rotation overlap with one another.

6. The building shrinkage compensation device of claim 5, wherein the axis of rotation of a first of the two gear members is not a central axis of the first of the two gear members.

7. The building shrinkage compensation device of claim 6, wherein the axis of rotation of a second of the two gear members is not a central axis of the second of the two gear members.

8. The building shrinkage compensation device of claim 1, wherein the locking member comprises two round gear members.

9. The building shrinkage compensation device of claim 8, wherein each of the round gear members has a central axis, and is separately rotatable relative to the fastener about an axis that is offset from the respective central axis.

10. A building shrinkage compensation device, comprising:

a base plate defining an intermediate hole laterally between opposite ends and a plurality of teeth laterally spaced from one another;

an elongate fastener extending longitudinally through the hole; and at least one gear member with a plurality of teeth circumscribing an outer periphery and configured to engage with the teeth in the base plate, wherein the gear member is longitudinally fixed and rotationally pivotable relative to the fastener, and the base plate is fixed to a surface of a first building member and the elongate fastener includes a proximal head and distal threading that is secured to a second building member spaced away from the first building member.

11. The building shrinkage compensation device of claim 10, wherein the at least one gear member is rotatable about a first axis $A_1$ that is not a central axis of the at least one gear member.

12. A building shrinkage compensation device, comprising:

a base defining an intermediate hole laterally between opposite ends and a plurality of teeth laterally spaced from one another;

an elongate fastener extending longitudinally through the hole;

a locking member comprising a pair of round gear members, a first gear member being rotatable about a first axis $A_1$ and a second gear member being rotatable about a second axis $A_2$, the locking member being mounted on the base plate with edge portions of the gears engaged with teeth in the base, wherein the locking member is longitudinally fixed relative to the fastener.

13. The building shrinkage compensation device of claim 12, wherein the first axis A1 and second axis $A_2$ are substantially coaxial with one another.

14. The building shrinkage compensation device of claim 12, wherein the first axis of rotation $A_1$ is not a central axis of the first round gear member.

15. The building shrinkage compensation device of claim 14, wherein the second axis of rotation $A_2$ is not a central axis of the second round gear member.

16. The building shrinkage compensation device of claim 12, wherein the first gear and second gear are joined to one another by a sleeve.

17. The building shrinkage compensation device of claim 16, wherein the sleeve is fixed in the longitudinal direction relative to the elongate fastener.

18. The building shrinkage compensation device of claim 17, wherein the elongate fastener passes freely through the hole of the base.

19. A building shrinkage compensation device, comprising:

a base defining a first hole extending therethrough from a first side to a second side and positioned between opposite lateral ends, the first side defining a plurality of teeth laterally spaced from one another and the second side being fixed on a surface of a first building member, the first building member defining a second hole aligned with the first hole;

an elongate fastener extending longitudinally through the first hole and the second hole;

a locking member mounted on the base plate, the locking member comprising two round gear members, each gear member having a plurality of teeth spaced about at least a portion of a circumferential perimeter, the teeth in each of the two gear members being engaged with teeth in the base plate, wherein the locking member is longitudinally fixed relative to the fastener and not longitudinally fixed relative to the base plate and first building member.

20. The building shrinkage compensation device of claim 19, wherein the elongate fastener has a distal end that is longitudinally fixed to a second building member that is longitudinally spaced from the first building member.

* * * * *